US010844563B1

(12) United States Patent
Coleman

(10) Patent No.: US 10,844,563 B1
(45) Date of Patent: Nov. 24, 2020

(54) FLOOD WALL PROTECTION SYSTEM

(71) Applicant: William J. Coleman, Rochelle Park, NJ (US)

(72) Inventor: William J. Coleman, Rochelle Park, NJ (US)

( * ) Notice: Subject to any disclaimer, the term of this patent is extended or adjusted under 35 U.S.C. 154(b) by 0 days.

(21) Appl. No.: 16/665,061

(22) Filed: Oct. 28, 2019

(51) Int. Cl.
*E02B 3/10* (2006.01)
*E06B 9/00* (2006.01)

(52) U.S. Cl.
CPC ..... *E02B 3/106* (2013.01); *E06B 2009/007* (2013.01)

(58) Field of Classification Search
CPC ..... E02B 3/106; E06B 2009/007
USPC ..... 52/202, 203, 479, 584.1, 169.6, 169.14; 49/61, 63, 64; 405/107, 110, 112, 114; 70/19
See application file for complete search history.

(56) References Cited

U.S. PATENT DOCUMENTS 4,136,856 A * 1/1979 Murdock ..... E01F 8/0035 256/24
4,439,061 A * 3/1984 Whipps ..... E02B 7/24 405/104
4,934,868 A * 6/1990 Hellstrom ..... E02B 7/22 405/103
5,077,945 A * 1/1992 Koeniger ..... E06B 9/00 405/114
6,042,301 A * 3/2000 Sovran ..... E02B 7/22 405/112
6,871,464 B2 * 3/2005 Hung ..... E06B 9/02 52/455
7,552,565 B1 * 6/2009 Smith ..... E06B 9/02 29/281.1
8,001,735 B2 * 8/2011 Fisher ..... E06B 9/02 52/202
8,245,461 B2 * 8/2012 Wei ..... E06B 9/02 52/202
9,376,778 B2 * 6/2016 Knezevich ..... E02B 7/54
2003/0082007 A1 * 5/2003 Liou ..... E06B 9/00 405/87
2004/0200169 A1 * 10/2004 Hung ..... E06B 9/02 52/455
2004/0231280 A1 * 11/2004 Abbott ..... E06B 9/02 52/716.2
2013/0272794 A1 * 10/2013 Osborne ..... E06B 9/02 405/110
2014/0110066 A1 * 4/2014 Rijlaarsdam ..... E02B 3/102 160/130

* cited by examiner

*Primary Examiner* — Edwin J Toledo-Duran
(74) *Attorney, Agent, or Firm* — Richard A. Joel

(57) ABSTRACT

A flood protection system comprises a plurality of stackable planks which mount at their ends to a building wall with a water tight seal. The wall mount includes a flat gasket portion directly affixed to the building and outwardly extending protrusions having a substantially T-shaped configuration located thereon such that a uniquely shaped gasket connected to a plank engages the substantially T-shaped outer portion of the protrusions to permit rapid stacking and disassembly of planks. The extruded aluminum planks include internal ribbing to provide added strength while eliminating the excessive weight of conventional planks. Unique anchor means may also be provided to stabilize the planks where long spans are involved.

7 Claims, 6 Drawing Sheets

FLOOD WALL PROTECTION SYSTEM

CROSS REFERENCE TO RELATED APPLICATIONS

Not Applicable.

STATEMENT REGARDING FEDERALLY SPONSORED RESEARCH OR DEVELOPMENT

Not Applicable.

PARTIES TO A JOINT RESEARCH AGREEMENT

Not Applicable.

DESCRIPTION

Field of the Invention

This invention relates to a flood barrier to protect properties from inundation and particularly to an adjustable barrier for attachment to buildings.

Background of the Invention

This novel invention is directed to a flood barrier system to prevent flood waters from entering buildings or other structures where the interior and utilities will be damaged by the waters. The proposed system is a unique improvement over the basic solution of sand-bagging buildings to prevent the entry of water. This invention is also a patentable improvement over the existing barriers represented by the prior art and discussed below.

Patent Publication 2013/0272794 discloses a flood barrier system having barrier support members with channels affixed to a building and stacked barrier members disposed within the channels at opposite ends thereof. The barrier members have a rigid front wall and a rigid rear wall spaced across a gap from each other to form a hollow body open at a least one end. Neither the sealing members nor the barrier members are similar or suggestive of the present invention and its advantages which provides an effective water seal and resists greater pressures.

Also of interest is the flood barrier system proposed in U.S. Pat. No. 8,001,735 to Fisher. The patent proposes a flood barrier system for temporarily sealing an opening in a wall structure against flood waters. The patent includes stackable barrier elements with end clamps pressing the ends against the outer surface of a wall providing seals along the opposite vertical edges of the opening. The barrier elements include a unique interlocking configuration that purportedly simplifies and expedites assembly plus strengthens integrity of the assembled structure. The present structure proposed herein by this invention is simpler, less expensive and provides a stronger and more secure seal. Other patents of interest include U.S. Pat. Nos. 5,493,316; 7,523,589 and 7,552,565.

SUMMARY OF THE INVENTION

The present invention provides a secure barrier against flood waters attempting to enter a building. The barrier includes a unique system of strong stackable planks which may be readily mounted across an opening in the event of danger from flood waters. The planks include internal reinforcing ribs which are located between outer aluminum skins on the planks to provide strength against water pressure. The rib design permits longer reaches with an effective barrier.

The extruded design of the unique barrier makes production costs reasonable while the reduced thickness of the planks eliminates excessive weight and facilitates storage. Further, the barrier is easily deployed in emergencies and dismantled thereafter for storage. The gaskets both on the planks and the unique wall mounts provide a water tight seal at the particular opening.

While prior art systems usually have a bolt which slides down a wall mount or a U-shaped channel which tightens the planks or logs to a gasket located on an inner wall mount, this invention has a specially designed oblong protrusion from a wall mount. This protrusion engages a slightly oversize accessory piece that can slide over the mount's protrusion and compress the wall gaskets for a tight seal. While prior art arrangements disclose the concept of stacking, the present device provides a straight forward surface to surface seal application instead of complex profile gaskets that need to be precisely installed and are costly to replace.

Accordingly, an object of this invention is to provide a new and improved flood harrier system.

Another object of this invention is to provide a new and improved flood barrier system including planks of a unique design.

Another object of this invention is to provide an economical flood barrier system including a unique sealing design which is easy to install and disassemble for storage.

A more specific object of this invention is to provide a new and improved flood barrier system with extended internally reinforced planks and a gasket sealing arrangement which facilitates assembly and provides a superior seal.

BRIEF DESCRIPTION OF THE DRAWINGS

The above and other objects and advantages of the present invention may be more clearly seen when reviewed in conjunction with the accompanying drawings wherein.

DETAILED DESCRIPTION OF THE INVENTION

Figure 1:
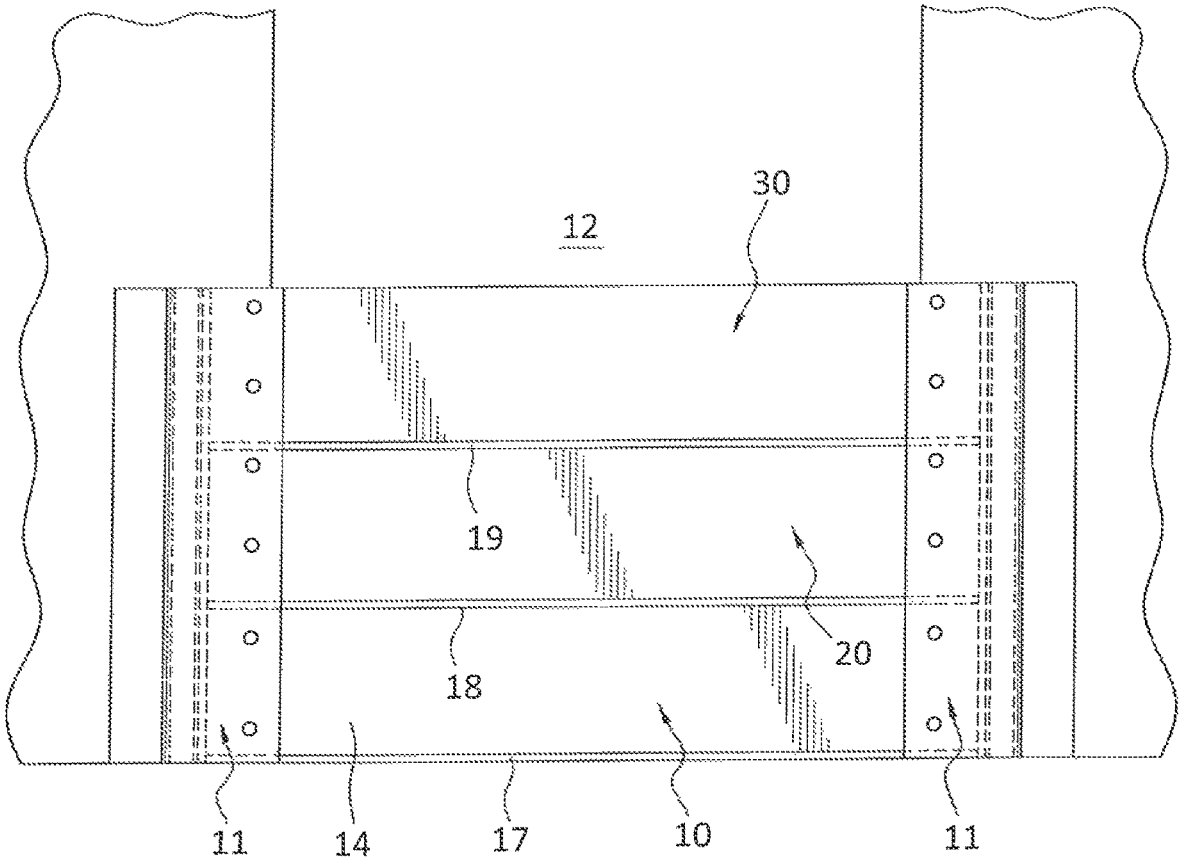
FIG. 1 is a plain view of the flood wall installed across a building opening showing the stacked planks coupled to wall mounts.
Figure 2A:
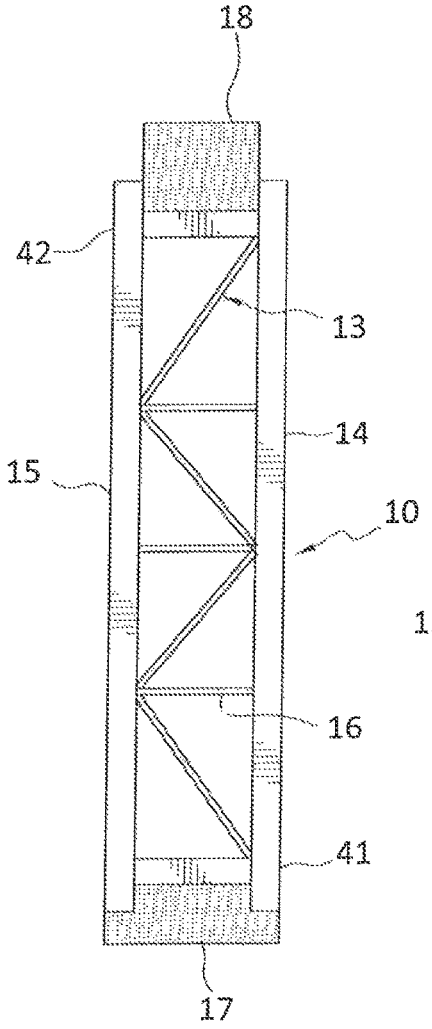
FIG. 2A is an end view of a bottom cross plank showing the internal support ribbing.
Figure 2B:
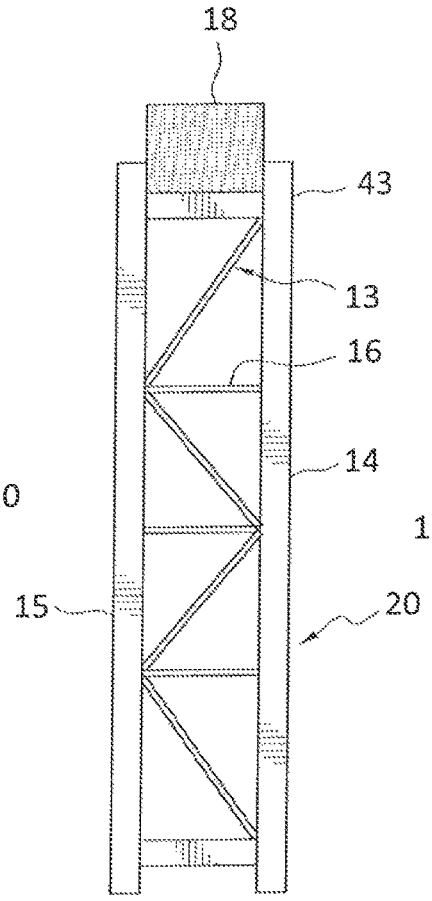
FIG. 2B is a middle cross plank, and, FIG. 2C is a top cross plank.
Figure 2C:
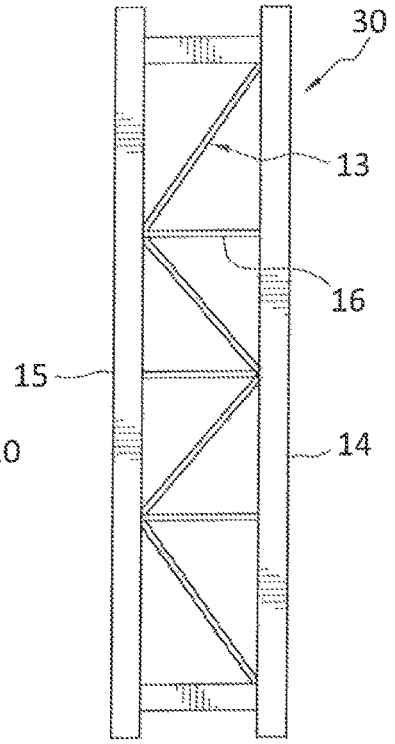

This invention relates to a flood wall protection system to protect building openings from intrusion of flood waters. As shown in FIG. 1 the invention comprises a plurality of elongated stacked planks 10, 20 and 30 which are affixed at their ends to a wall mount 11, The hollow planks 10, 20 and 30 are of a unique design with structural ribbing 13 located between inner and outer faces 14, 15. The ribbing 13 runs between the faces 14 and 15 in a saw-tooth pattern with a cross-rib 16 where the saw tooth pattern engages the opposite face. This design, preferably of aluminum, is structurally stronger than prior art planks and able to withstand more lateral impact for its size. The reduced thickness of the planks 10, 20 and 30 eliminates excessive weight and facilitates handling and storage. For flexibility, the planks may be either 6 inches or 12 inches in width and formed to a required length.

The bottom cross plank 10 engages a gasket 17 with its extensions 41 which extend along the surface of the opening 11 to form a water-tight seal. The cross plank 10 also engages a gasket 18 along its upper surface between extensions 42 to form a seal with the stacked middle cross plank 20. Normally an installation would include several middle cross planks 20 to provide height to the barrier.

A middle cross plank includes a similar gasket 18 running along its upper surface between extensions 43 to provide a seal with the next stacked middle cross plank 20. Finally, a top cross plank 30 is mounted atop the gasket 18 of the highest plank. 20 to form the final seal. The number of middle stacked planks depends upon the height of the water anticipated.

Figure 3:
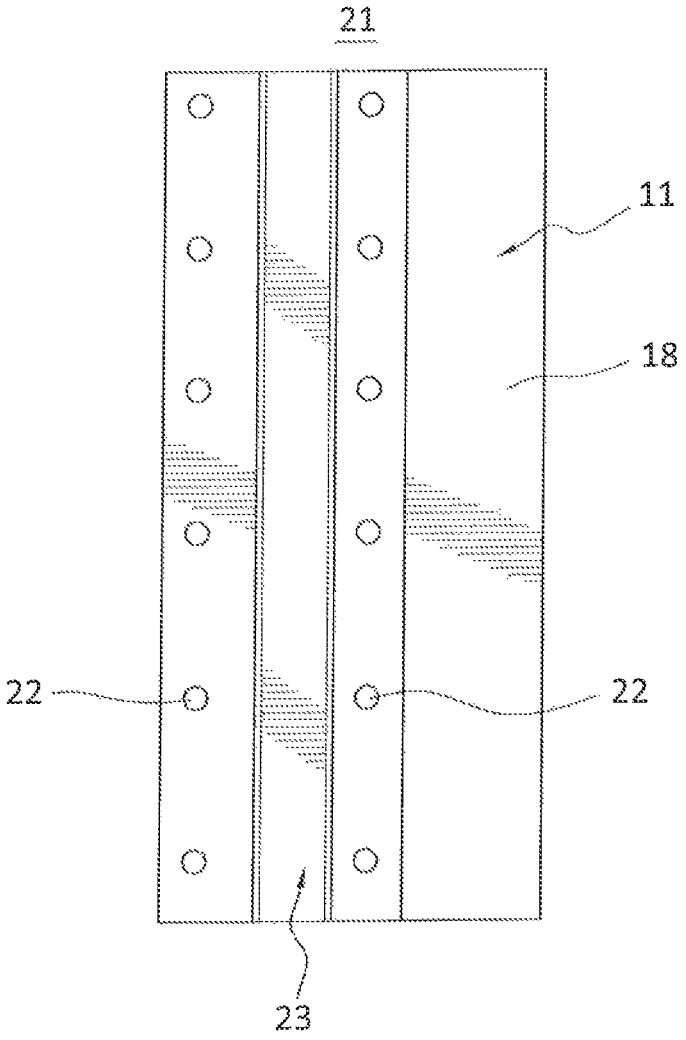
FIG. 3 is a plan view of a wall mount to be affixed to a building wall.
Figure 4:
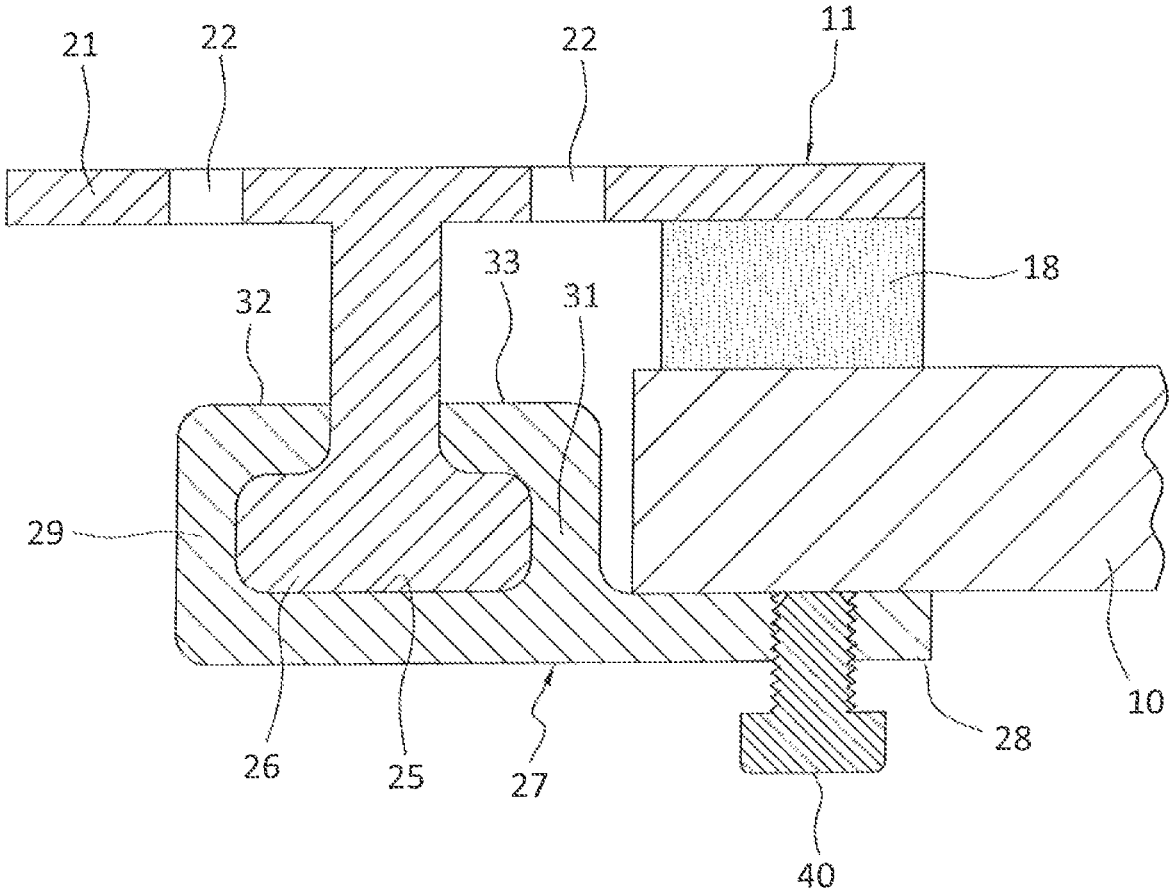
FIG. 4 is a top cross sectional view of the sealing assembly mounting the cross plank to a wall in a water tight seal.

As shown in FIG. 3 and FIG. 4, the wall mount 11 comprises a rectangular metal member 21 attached through screw holes 22 to a building. The member 21 includes projection 23 which is a substantially T-shaped member with the head of the "T" 26 engaging an opening 25 in gasket member 27. The member 27 comprises an extending base portion 28, an inwardly extending end position 29 and an intermediate inwardly extending portion 31. The end portion 29 and the intermediate portion 31 include respective end portions 32, 33 which extend towards one another but have a space 25 to accommodate and lock the substantially T-shaped member 26 in place.

The base portion 28 engages to a cross plank 10, 20 or 30 by a compression to gasket screw 40 which forces the cross plank 10, for example, against the gasket 18 forming a seal. The oblong protrusion 26 from the wall mount 11 accepts a slightly oversize accessory gasket 27 that can slide over the mount protrusion 25 and reinforce the wall gaskets 21 for a tight seal.

Figure 5:
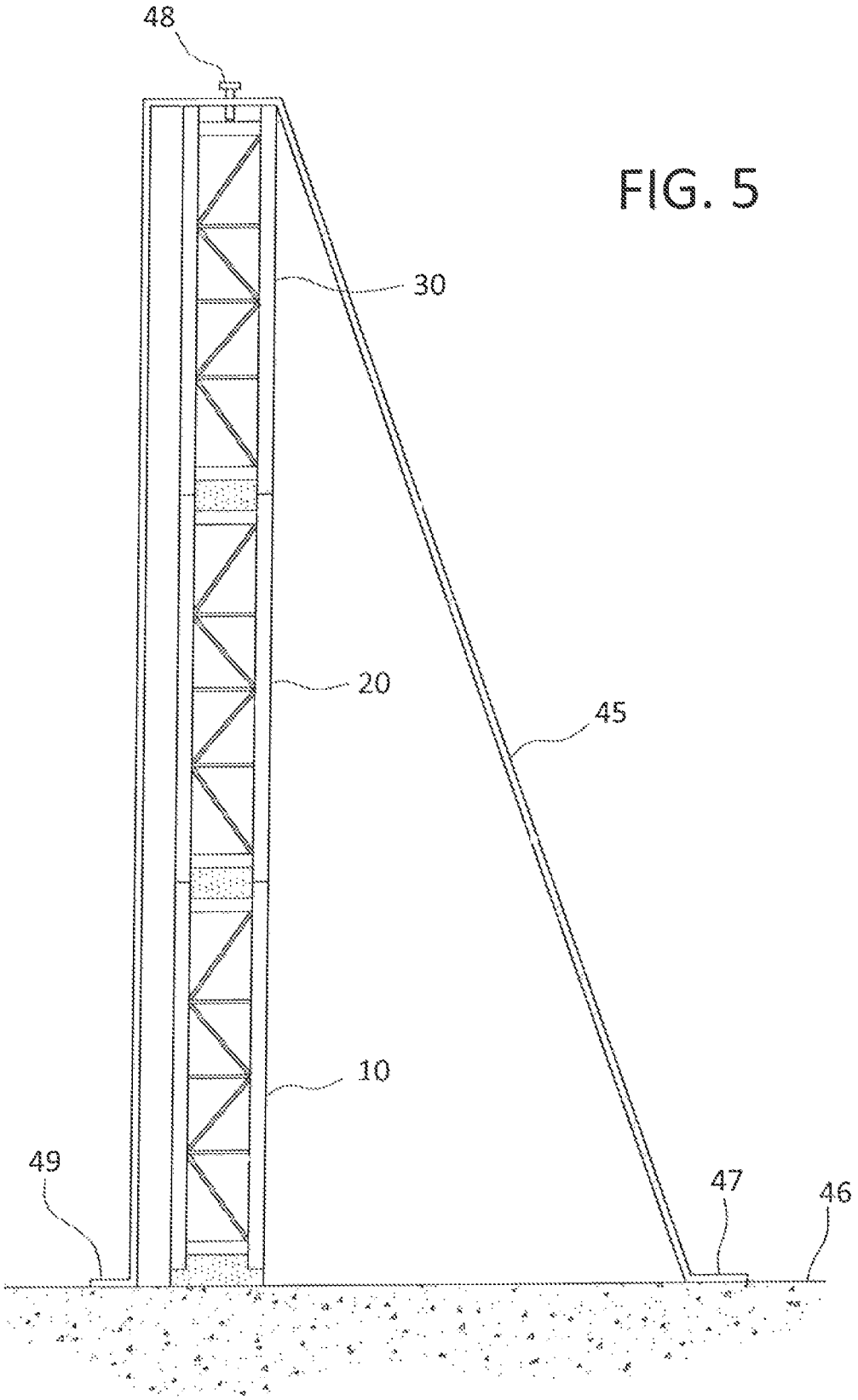
FIG. 5 is a side view depicting an anchor arrangement which permits a long plank span with lateral support; and, FIG. 6 is a side view of a clamping arrangement affixed to the top plank.

As shown in FIG. 5, an anchor arrangement can be used to provide lateral support for long spans. A shaped metal bar or rectangular member 45 is secured to a concrete floor 46 with an anchor 47 at one end and extends upwardly and at an angle to the stacked planks 10, 20 and 30. The upper portion of the bar extends horizontally over the top plank 30 and is secured thereto by a compression screw 48. The bar 45 then extends vertically downward to a second anchor 49. Means may be provided to permit pivoting at the anchor 47 to permit various angles and the bar or rectangular member may be made in sections.

Figure 6:
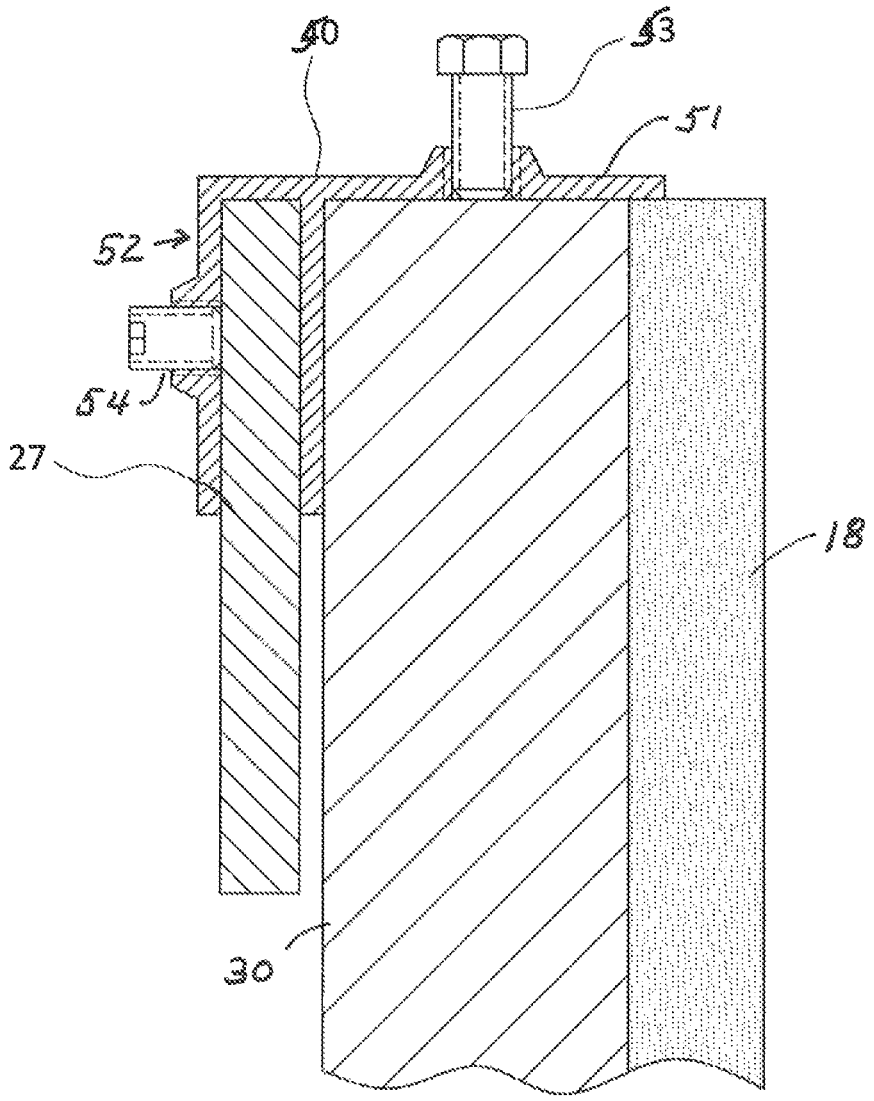

FIG. 6 depicts a bracket 50 which includes a base portion 51 and a V-shaped portion 52 extending downwardly at a right angle at one end of the bracket 50. The gasket 27 is portioned within the V-shaped portion 32 and compression screw 33 secures the bracket 50 to the top plank 30 while set screw 54 secures bracket 50 to gasket 27, This prevents the planks from moving upward under the pressure of flood waters.

For residential applications the invention could be made available without long production times and sold in kits. Because applicant's system is totally extruded, no initial customization is needed. Mounts 11 also can be either removable or permanent with protective covers. This invention without complex profile gaskets is faster to install and less expensive, yet achieves a superior water tight seal.

While the invention has been explained by a detailed description of certain specific embodiments, it is understood that various modifications and substitutions can be made in any of them within the scope of the appended claims which are intended also to include equivalents of such embodiments. ID

What is claimed is:

1. A flood barrier system for sealing a ground level opening between opposite walls, each having an exterior wall portion from the intrusion of water comprising:

a mount on each exterior wall portion extending upwardly from ground level and having an inner portion, an intermediate portion, and an outer portion further including a mount gasket attached along the inner portion; and a protruding portion extending outwardly along the intermediate portion and terminating in a transverse end portion forming a T-shape;

a plurality of elongated planks each having a top and a bottom portion and respective end portions and said planks including a bottom cross plank, at least one middle cross plank and a top cross plank each extending between the wall mounts and being stacked to seal the opening, and wherein the bottom cross plank includes bottom cross plank gaskets at the top and bottom portions thereof and each middle cross plank includes a middle cross plank gasket extending along the top portion thereof; and wherein:

the top, middle and bottom cross planks are mounted to the exterior wall portion at each end portion comprising the T-shaped intermediate protruding portion extending outwardly from the wall mount and a mount gasket mounted to each of the planks and having an opening to engage the T-shaped protruding portion and further including a compression screw to force each cross plank directly against a wall mounted gasket and seal the protruding portion against the mount gasket mounted to the plank.

2. The flood barrier system for sealing a ground level opening between opposite walls, each having an exterior wall portion, from the intrusion of water in accordance with claim 1, wherein:

the planks each comprise a hollow metal member having an inner and outer metal skin along the length thereof; and, a reinforcing ribbing located between said inner and outer skin having a saw tooth configuration running along the plank and cross ribbing where the saw tooth ribbing contacts the outer skin at the top and bottom portions of the planks.

3. The flood barrier system for sealing a ground level opening between opposite walls, each having an exterior wall portion, from the intrusion of water in accordance with claim 2, wherein;

the planks engage the gasket protruding portions, said portions including a gasket mounted to the end of each cross plank having an aperture which directly engages a wall protruding portion of the wall mount and the compression screw comprises a compression gasket screw which forces each cross plank against the wall mounted gasket and the plank mounted gasket directly against the protruding portion to form a water tight seal.

4. The flood barrier system for sealing a ground level opening between opposite walls, each having an exterior wall portion from the intrusion of water in accordance with claim 3, wherein:

the protruding portion comprises a substantially T-shaped member having a base portion directly attached to the wall mount, an elongated portion extending outwardly therefrom and a cross portion at the end thereof for engagement with a plank mounted gasket aperture.

5. The flood barrier system for sealing a ground level opening between opposite walls, each having an exterior wall portion, from the intrusion of water in accordance with claim 1, further including:

an anchor engaging the top plank at a predetermined intermediate location comprising:

an integral preformed member extending upwardly at an angle on one side of the top plank, a first base anchor portion, said base anchor portion being anchored to the ground, and connected to the angled integral preformed member, an intermediate anchor portion extending over and adjacent the top plank and a vertical portion extending downwardly on the opposite side of the top plank to the ground from the intermediate anchor portion and a second base anchor portion mounted to the ground, and, a compression screw mounting the intermediate portion of the anchor to the top cross plank to provide further lateral support to the planks.

6. The flood barrier system for sealing a ground level opening between opposite walls, each having an exterior wall portion, from the intrusion of water in accordance with claim 5, wherein:

the first base anchor portion is adjustable to different angles for the upwardly extending integral preformed member.

7. A flood barrier system for sealing a ground level opening between opposite walls, each having an exterior wall portion, from the intrusion of water comprising:

a mount on each exterior wall portion extending upwardly from ground level and having an inner portion, an intermediate portion, and an outer portion further including a mount gasket attached along the inner portion; and a protruding portion extending outwardly along the intermediate portion and terminating in a transverse end portion forming a T-shape;

a plurality of elongated planks each having a top and a bottom portion and respective end portions and said planks including a bottom cross plank, at least one middle cross plank and a top cross plank each extending between the wall mounts and being stacked to seal the opening, and wherein the bottom cross plank includes bottom cross plank gaskets at the top and bottom portions thereof and each middle cross plank includes a middle cross plank gasket extending along the top portion thereof; and wherein:

the top, middle and bottom cross planks are mounted to the exterior wall portion at each end portion comprising the T-shaped intermediate protruding portion extending outwardly from the wall mount and a mount gasket mounted to each of the planks and having an opening to engage the T-shaped protruding portion and further including a compression screw to force each cross plank directly against a wall mounted gasket and seal the protruding portion against the mount gasket mounted to the plank; said barrier system further including:

an elongated member portion at each wall engaging the top plank and a downwardly extending compression screw extending through said member to contact said top plank, and, prevent upward movement of the planks; and, an outer downwardly extending U-shaped portion having inner and outer legs engaging the protruding portion of the wall mount; and, a set screw extending through the outer leg of the downwardly extending portion to engage the protruding portion of the wall mount.

* * * * *